US007228871B2

(12) United States Patent
Lothe

(10) Patent No.: US 7,228,871 B2
(45) Date of Patent: Jun. 12, 2007

(54) DEVICE FOR REDUCING SEPARATION OF VOLATILE ORGANIC COMPOUNDS FROM OIL DURING FILLING OF TANKS

(75) Inventor: Per Lothe, Førresfjorden (NO)

(73) Assignee: Knutsen Oas Shipping AS (NO)

( * ) Notice: Subject to any disclaimer, the term of this patent is extended or adjusted under 35 U.S.C. 154(b) by 265 days.

(21) Appl. No.: 10/515,520

(22) PCT Filed: May 15, 2003

(86) PCT No.: PCT/NO03/00159

§ 371 (c)(1),
(2), (4) Date: Nov. 23, 2004

(87) PCT Pub. No.: WO03/102462

PCT Pub. Date: Dec. 11, 2003

(65) Prior Publication Data

US 2005/0166982 A1 Aug. 4, 2005

(30) Foreign Application Priority Data

May 31, 2002 (NO) ..... 20022582

(51) Int. Cl.
*F17B 1/12* (2006.01)

(52) U.S. Cl. ..... 137/592; 137/888

(58) Field of Classification Search ..... 137/114, 137/888 I, 592
See application file for complete search history.

(56) References Cited

U.S. PATENT DOCUMENTS 1,144,868 A * 6/1915 Roy ..... 261/77
1,195,915 A * 8/1916 Damrow ..... 417/151
2,784,560 A * 3/1957 Johnson, Jr. ..... 62/47.1
3,003,325 A 10/1961 Poethig et al.
6,279,611 B2 * 8/2001 Uematsu et al. ..... 137/888
6,852,145 B2 * 2/2005 Muller ..... 95/216

FOREIGN PATENT DOCUMENTS

NO 19996471 12/1999

OTHER PUBLICATIONS

Patent Abstracts of Japan, vol. 007, No. 137, Jun. 15, 1983 & JP 58060398 A (Tokyo Gas KK) Mar. 24, 1983 Abstract.

Database WPI Week 199807, Derwent Publications Ltd., London, GB; AN 1998-066200, & JP 9303697 A (Ishikawajima Harima Heavy Ind.) Nov. 28, 1997 Abstract.

Database WPI Week 20056, Derwent Publications Ltd., Longdon GB; AN 2000-592237 & JP 2000240896 A (Osaka Gas Co. Ltd.) Sep. 8, 2000 Abstract.

* cited by examiner

*Primary Examiner*—Stephen M. Hepperle
(74) *Attorney, Agent, or Firm*—Andrus, Sceales, Starke & Sawall, LLP

(57) ABSTRACT

A device for reducing evaporation of volatile organic compounds (VOC) during filling of a substantially liquid petroleum product into a storage and/or transportation tank (18) via a down pipe (14), wherein the down pipe (14), which has a non-constricted flow-section, is provided with an inlet (22) for gas at its upper portion, the inlet (22) being arranged to enable inflow of gas due to the underpressure being formed in the upper portion of the down pipe (14) when the petroleum product flows down through the down pipe (14).

3 Claims, 3 Drawing Sheets

DEVICE FOR REDUCING SEPARATION OF VOLATILE ORGANIC COMPOUNDS FROM OIL DURING FILLING OF TANKS

CROSS REFERENCE TO RELATED APPLICATION

The present application is the U.S. national stage application of International Application PCT/N003/00159, filed May 15, 2003, which international application was published on Dec. 11, 2003 as International Publication WO 03/102462. The International Application claims priority of Norwegian Patent Application 20022582, filed May 31, 2002.

BACKGROUND OF THE INVENTION

This invention concerns a device for reducing the fraction of volatile organic compounds (VOC) being separated from oil, especially crude oil, during filling of larger tanks, as is customary when, for example, loading a ship from a terminal, a production platform or a floating loading device.

Crude oil normally contains fractions of lighter and heavier gasses that, due to their volatility, may not be transported together with the liquid fraction of the crude oil. From a transport technical point of view, it would be advantageous if the crude oil was separated into a gas fraction, a wet gas fraction and a liquid fraction. To separate and transport petroleum products from a producing field in three fractions, however, is associated with significant extra costs, and therefore it is more common to separate the crude oil into a gas- and a liquid fraction. The wet gas phase therefore is divided into a lighter fraction, which is transported together with the gas fraction, and a heavier fraction, which is transported together with the liquid fraction.

During loading at a moderate overpressure of a liquid petroleum fraction containing heavier gasses, such as propane and butane, gasses from the volatile fraction continuously evaporate. In order to avoid a pressure increase in the transport and storage tanks, the evaporation gasses, i.e. the volatile organic compounds, must be extracted from the tanks and be carried onwards to incineration or to a re-injection facility.

A relatively substantial evaporation of volatile organic compounds is known to take place while pumping oil into larger tanks. A pressure in the range of 1.05 to 1.07 bar normally is maintained in both storage and transport tanks. When loading a tanker, for example, the oil normally is pumped from a storage tank and through a supply pipe to a position above the cargo tank, from which position the oil is guided into the tank through a down pipe down to the bottom portion of the tank. A down pipe of this type may be of a length in the order of several tens of meters.

When the oil flows into the upper end portion of the down pipe, the force of gravity will accelerate the liquid flowing downward in the down pipe, whereby a lesser total pressure is formed in the supply pipe and in the upper portion of the down pipe. In these pipes having a lesser total pressure, a substantial evaporation of volatile organic compounds takes place, these only being insubstantially condensed into liquid phase when the pressure again increases to the ordinary pressure of the tank.

NO 19996471 concerns a down pipe provided with a venturi, in which the venturi being arranged to condense gasses that already have separated from a cargo tank. The device according to NO 19996471 is not arranged to restrain volatile gasses from separating from the oil when being loaded into the cargo tank.

SUMMARY OF THE INVENTION

The object of the invention is to remedy the disadvantages of prior art.

The object is achieved in accordance with the features provided in the description below and in the subsequent patent claims.

By providing the upper portion of the down pipe with a inlet through which gasses may flow into the down pipe, the underpressure is reduced substantially in the fall pipe portion of concern. Preferably, the inlet must be formed in such a way that a reduction in flow-section at the inlet of the down pipe does not exist.

The inlet may be placed anywhere within the upper portion of the down pipe, but it is preferable to place the inlet immediately below the lid of the transport or storage tank. Gasses already evaporated from the oil thus may flow into the down pipe.

Experiments have shown that the evaporation of volatile organic compounds during loading is reduced substantially by preventing the formation of an underpressure in supply- and down pipes.

The device according to the invention is equally suited for use during loading and unloading of ships and other, larger tank installations when oil or oil products, such as gas and liquid natural gas, are to be moved.

BRIEF DESCRIPTION OF THE DRAWING

In the following a non-limiting example of a preferred device is described, the device being shown in the accompanying drawings, where.

DETAILED DESCRIPTION OF THE INVENTION

Figure 1:
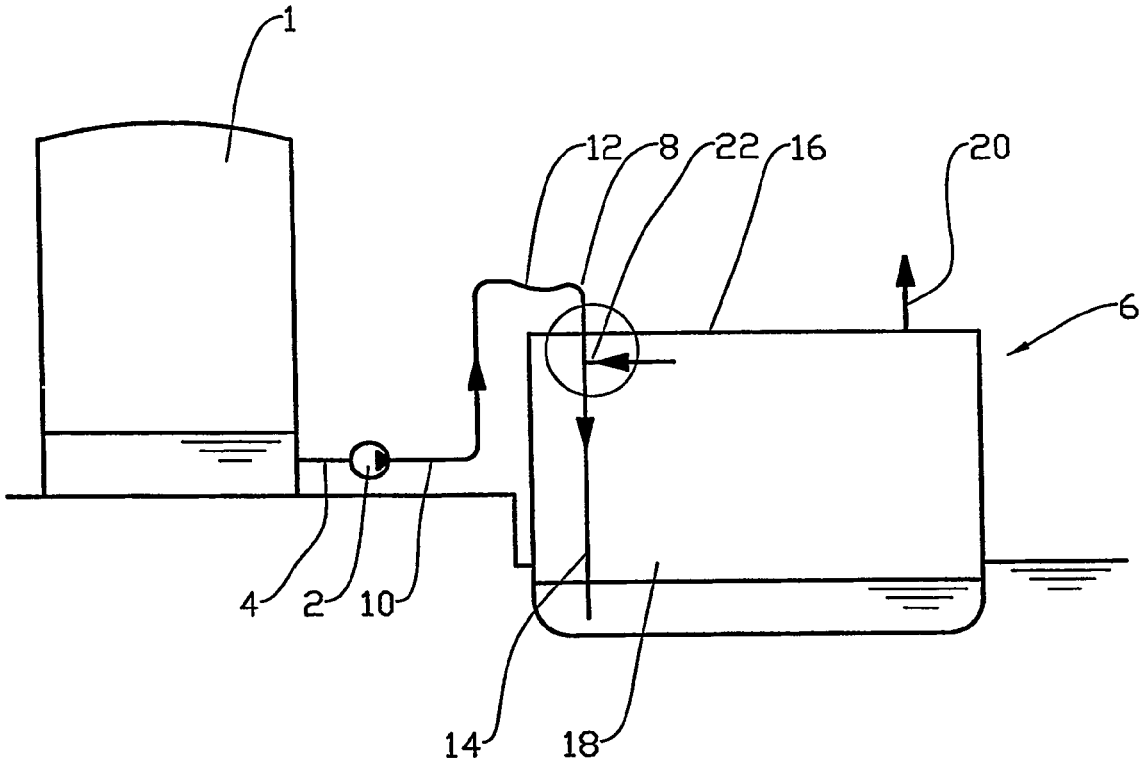
FIG. 1 schematically shows a loading arrangement, in which oil is pumped from a storage tank onto a tanker.

On the drawings the reference numeral 1 denotes an oil storage tank. A pump 2 is connected to the storage tank 1 via a pipe 4 and onto a loading point 8 of a tanker 6 via a pipe 10 and a flexible connection/hose 12.

A fall pipe 14 extends from the loading point 8 of the tanker 6 and down through the deck 16 of the tanker 6 onto the bottom portion of the cargo tank 18 of the tanker 6. A gas outlet 20 extends from the top of the cargo tank 18 onto a gas treatment facility (not shown).

An arrow immediately below the deck 16 of FIG. 1 indicates the position at which gas flows into the down pipe 14 through an inlet 22. Arrows on the drawings indicate flow directions of fluids.

As stated in the general part of the description, it is advantageous for the flow-section of the down pipe 14 not to be reduced at the inlet 22. A reduction in flow-section would cause the inflowing oil to be inflicted with a velocity increase at the inlet 22. The static pressure of the oil thus would be reduced, causing further evaporation of VOC to happen.

Figure 2:
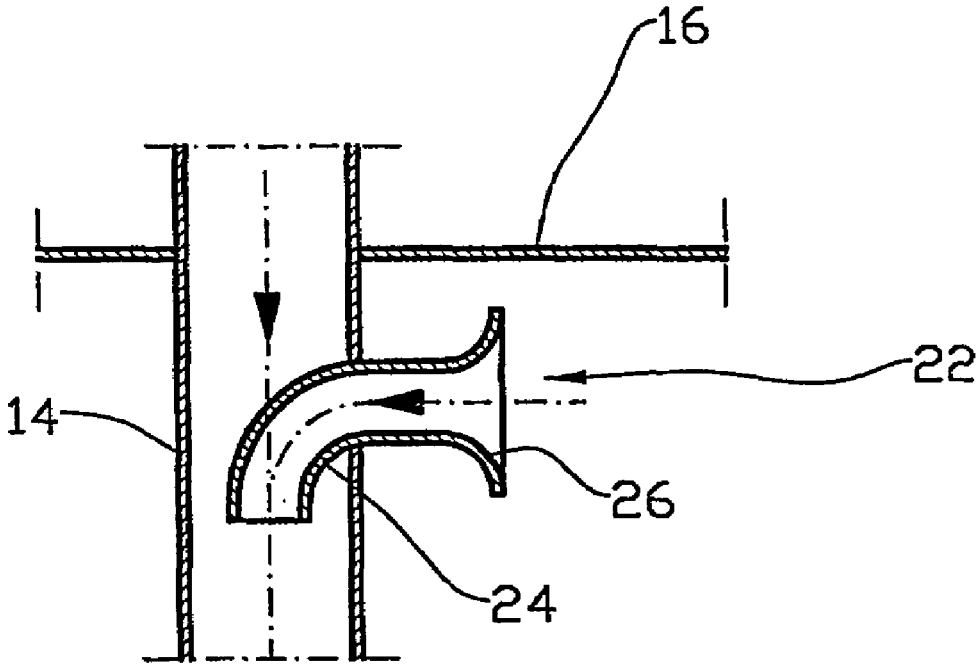
FIG. 2 shows, in larger scale, the upper portion of the down pipe.

An inlet 22 comprises a pipe bend 24, cf. FIG. 2, extending through the wall of the down pipe 14 onto the outside of the down pipe 14, a bell-shaped inlet funnel 26 being connected thereto in order to reduce the inflow loss of the inflowing gas. The internal flow-section of the pipe bend 24 relative is to the flow-section of the down pipe 14 is dimensioned in a manner allowing a suitable amount of gas to flow in through the pipe bend 24 during the first phase of the tank filling when relatively little oil is contained in the cargo tank 18.

Figure 3:
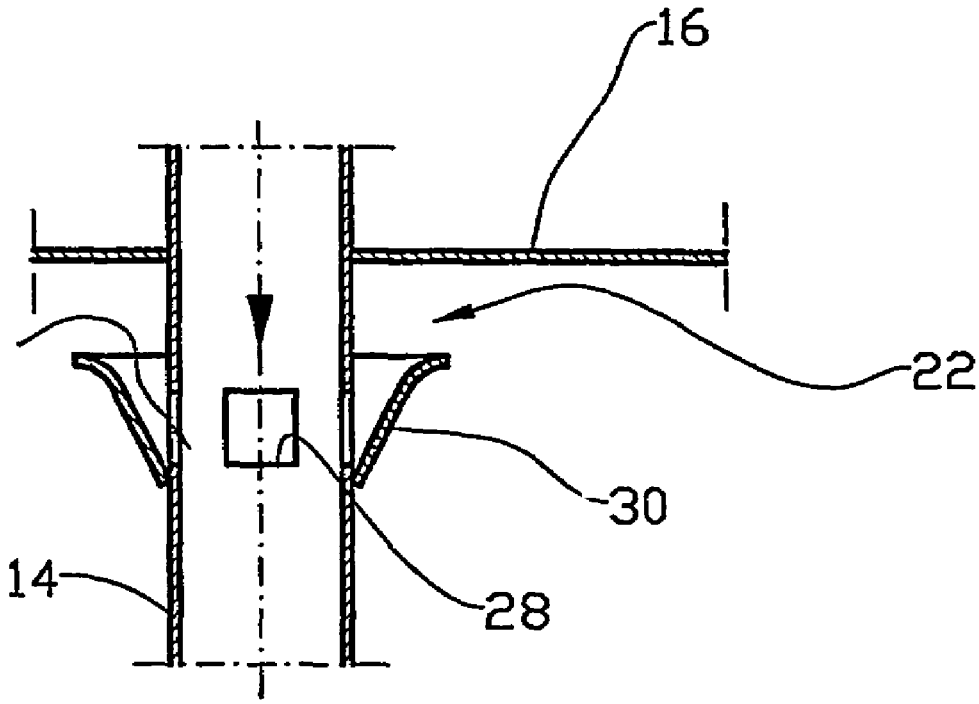
FIG. 3 shows an alternative embodiment of the upper portion of the fall pipe.

In an alternative embodiment, cf. FIG. 3, the inlet is formed with encircling openings 28 in the wall of the down pipe 14. An external, tapered, bell-shaped shield/ring 30 that preferably encircles the down pipe 14, protrudes up- and outward from the down pipe 14 at the lower portion of the openings 28 and onto a level higher up than that of the upper portion of the openings 28. The shield 30 is arranged to restrain fluid that flows down through the down pipe 14, from flowing out of the openings 28.

When oil containing volatile organic compounds is pumped by the pump 2 from the storage tank 1 via the pipes 4, 10 and the hose 12 onto the loading point 8 of the tanker 6 and further down through the down pipe 14, gas simultaneously flows through the pipe bend 24, or alternatively through the openings 28, and into the down pipe 14 where gas is mixed with the inflowing oil.

Through appropriate dimensioning of the inlet 22, a suitable amount of gas is carried into the down pipe 14, whereby the underpressure in the upper portion of the down pipe 14 is significantly reduced during loading. Thereby the forming of an underpressure in the pipes/hose 10, 12, 14 also is substantially prevented. Thus evaporation of volatile organic compounds during loading is reduced substantially.

According to the invention, only the underpressure formed due to inflowing oil falling down through the down pipe 14 causes the intake of gasses at the upper portion of the down pipe 14. Emphasis is placed on avoiding reductions in flow-section within the down pipe 14, inasmuch as such reductions will cause further separation of VOC from the oil.

The invention claimed is:

1. In a liquid petroleum storage tank containing at least gas that is at or near ambient pressure, a method for reducing formation of volatile organic compounds (VOCs) during filling of the tank, the method comprising the steps of:

providing a liquid petroleum storage tank with a downpipe that has a non-constricted flow path along its entire length inside the tank;

providing an inlet connecting the non-constricted flow path with the gas inside of the tank;

introducing liquid petroleum that is at or near ambient temperature and pressure into the downpipe to fill the tank, thereby creating an underpressure in the upper portion of the downpipe compared to the pressure of the gas inside the tank; and using the underpressure to draw gas from inside the tank through the inlet and into the downpipe to thereby reduce the underpressure and reduce evaporation of the liquid petroleum as it is introduced into the tank.

2. The method of claim 1, wherein the inlet comprises at least one through-going opening in a wall of the downpipe.

3. The method of claim 2, comprising the step of providing a shield that protrudes up and outward from the downpipe, the lower portion of the shield being placed at the lower limit of the at least one opening and the upper portion of the shield protruding onto a level located higher up than that of the upper limit of the at least one opening.

* * * * *